United States Patent [19]

Melby

[11] Patent Number: 4,614,048

[45] Date of Patent: Sep. 30, 1986

[54] SNOW PLOW APPARATUS WITH HINGED SIDE BLADE

[76] Inventor: Phillip J. Melby, Box 656, Mason City, Iowa 50401

[21] Appl. No.: 799,256

[22] Filed: Nov. 18, 1985

[51] Int. Cl.[4] ..... E01H 5/06

[52] U.S. Cl. ..... 37/280; 172/815

[58] Field of Search ..... 37/280, 281, 104; 172/825–826, 815, 822–823

[56] References Cited

U.S. PATENT DOCUMENTS

| | | | |
|---|---|---|---|
| 2,964,862 | 12/1960 | Lotz | 37/280 X |
| 2,988,831 | 6/1961 | Burns | 37/50 |
| 3,208,166 | 9/1965 | Proulx | 37/42 |
| 3,231,991 | 2/1966 | Wandscheer | 37/42 |
| 3,279,104 | 10/1966 | Wandscheer et al. | 37/281 X |
| 3,407,519 | 10/1968 | Batko | 37/42 |
| 3,422,552 | 1/1969 | Gabel | 37/42 |
| 3,477,151 | 11/1969 | Zanella | 37/42 |
| 4,077,139 | 3/1978 | Fagervold | 37/41 |
| 4,145,825 | 3/1979 | Bertolino | 37/42 |
| 4,208,812 | 6/1980 | Brownly | 37/280 |
| 4,217,707 | 8/1980 | Karlsson | 37/41 |
| 4,356,645 | 11/1982 | Hine | 37/281 |
| 4,479,312 | 10/1984 | Turgeon | 37/281 X |

*Primary Examiner*—E. H. Eickholt

*Attorney, Agent, or Firm*—Robert T. Johnson

[57] ABSTRACT

A conventional snow plow comprises a scraper blade set at an angle, which then deposits a ridge of snow at the railing edge of the scraper blade. This ridge of snow creates problems at driveways and crosswalks.

This present invention discloses a snow plow apparatus to control deposit of ridge of snow and thus prevent said ridge of snow at driveways, crosswalks, etc.

3 Claims, 7 Drawing Figures

SNOW PLOW APPARATUS WITH HINGED SIDE BLADE

Snow plows comprise a snow plow scraper blade, diagonally mounted on the front of a tractor or truck, with the plow set at angle of about 65° more or less. The angle to be set depending on snow depth or snow load.

The angle can be indentified as the angle of the snow plow face long axis to the horizontal axis of the tractor or truck on which the snow plow is mounted.

The problem encountered with a conventional snow plow is build up of a snow ridge on the dump off or trailing edge of the snow plow. This snow ridge of plowed snow causes a problem in driveways along the road being plowed.

It is an object of this invention to disclose a snow plow and adjustable wing attached thereto to control the deposit of the snow ridge, to prevent deposit of the snow ridge in driveways.

Another object of this invention is to disclose a two component snow plow scraper blade comprised of scraper blade and adjustable wing attached thereto, said wing being pivotable on hinge mounts.

Another object of this invention is to disclose a snow plow scraper blade comprised of two segments, one segment being the major portion of the snow plow scraper blade and a snow plow scraper wing segment attached thereto as a minor portion of the scraper blade.

Another object of this invention is to disclose a two component snow plow scraper blade comprised of two segments, one segment being the major segment of the snow plow scraper blade and a snow plow wing segment attached thereto, and wherein the attached wing segment is mounted on pivot pin hinges and extends outwardly from the trailing end of the major segment of the scraper blade.

Another object of this invention is to disclose a snow plow scraper blade comprised of two segments, one segment being the major segment of the snow plow scraper blade and a snow plow scraper wing segment attached thereto by hinges and wherein the wing segment is movable in a forward and retracted direction by means of a hydraulic piston.

Another object of this invention is to disclose snow plow apparatus wherein the improvement comprises a two component snow plow scraper blade consisting of a major segment of snow plow scraper blade and a snow plow scraper wing blade segment attached to said major segment of scraper blade by means of hinge mounts connecting said scraper wing blade segment to said major segment of scraper blade, and hydraulic piston rod attached to scraper wing drive arm attached to said scraper wing blade segment, and means to actuate said hydraulic piston rod to move said scraper wing blade segment in a forward and return direction.

Another object of this invention is to disclose snow plow apparatus wherein the improvement comprises a two component snow plow comprising a scraper wing blade segment attached to the major segment of snow plow scraper blade by means of hinges and wherein the leading edge of said scraper wing blade segment is attached to the trailing edge of said major segment of snow plow scraper blade.

Another object of this invention is to disclose snow plow apparatus wherein the improvement comprises a snow plow scraper wing blade segment attached to major segment of snow plow scraper blade front face by means of hinges, and wherein the trailing edge of said scraper wing blade segment is aligned with the trailing edge of major segment of snow plow scraper blade and the leading edge of said scraper wing blade segment is hingedly joined to the face of said major segment of snow plow scraper blade and a slot is provided in said major segment of scraper blade for piston rod actuation of scraper wing blade segment drive arm, said scraper wing blade segment drive arm attached to said snow plow scraper wing blade segment.

Another object of this invention is to disclose a two component snow plow apparatus wherein the improvement consists of a snow plow scraper wing blade segment attached by means of hinges to major segment of snow plow scraper blade and said scraper wing blade segment is seperately pivotable actuated by means of hydraulic piston, on said hinges.

Another object of this invention is to disclose means for actuating separately pivotable snow plow scraper wing blade segment, said means consisting of hydraulic piston attached to said scraper wing blade arm.

SUMMARY OF THE INVENTION

On plowing of snow from city streets by means of a snow plow, a problem is encountered of leaving a ridge of plowed snow at driveways adjoining the streets.

To overcome this problem of the snow ridge formed across a driveway by a snow plow, this invention discloses a two component snow plow scraper blade consisting of a separately movable snow plow scraper wing segment attached to the trailing end of the snow plow scraper blade such that when the snow plow comes to a driveway, the separately movable snow plow scraper wing segment is pivoted forward on its hinge by actuation of a hydraulic piston to push said wing segment forward to thus prevent a snow ridge from forming as the snow plow moves past a driveway. The separately movable snow plow scraper wing segment is then moved rearward to resume the snow plow operation.

Fitting present snow plow blades:

- 1—Snow plow scraper blade.
- 2—Snow plow scraper wing segment.
- 4—Hinges and mounts.
- 16—Scraper blade top deflector.
- 16'—Scraper blade wing segment top deflector.
- 17—Scraper blade bottom.
- 17'—Scraper wing segment blade bottom.
- 18—Concave face surface of scraper blade.
- 18'—Concave face surface of scraper blade wing segment.

Figure 1:
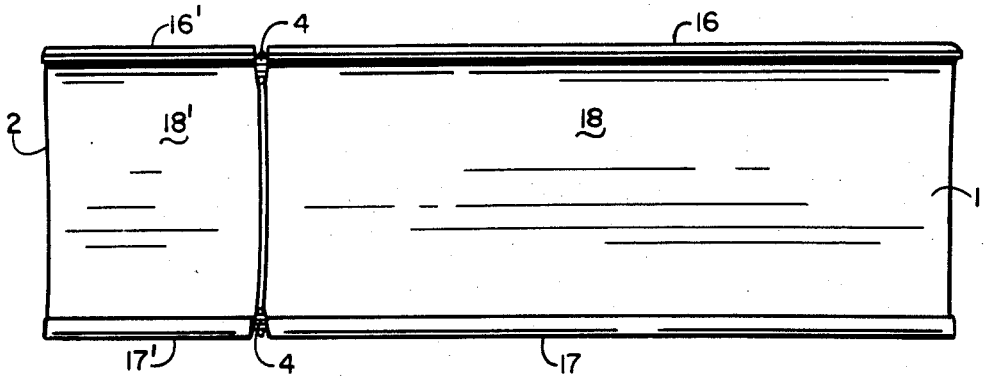
FIG. 1—Front Elevation
Figure 2:
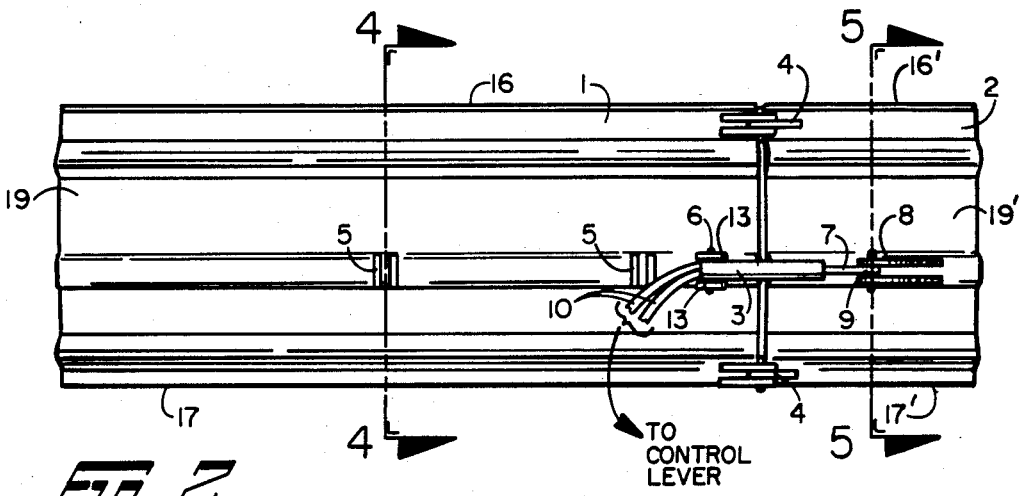
Figure 3:
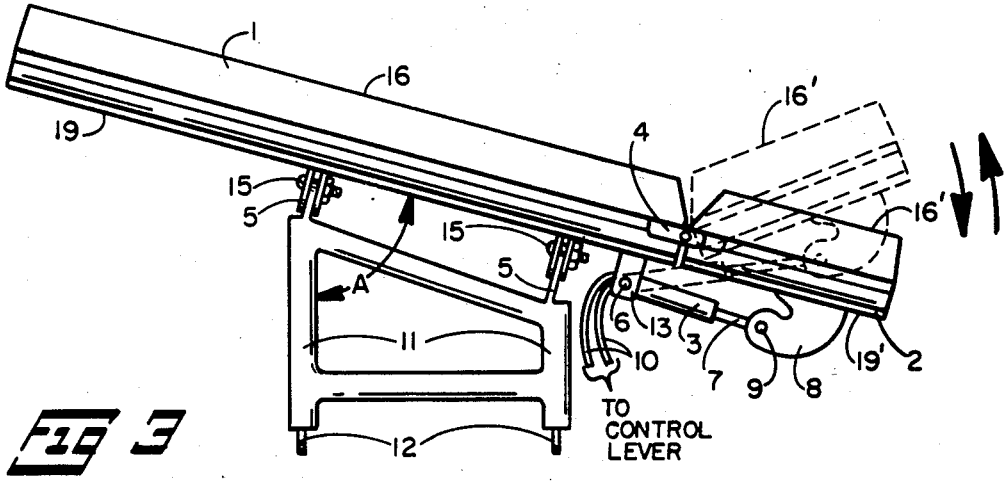

FIG. 2—Rear Elevation

- 1—Snow plow scraper blade.
- 2—Snow plow scraper wing segment.
- 3—Hydraulic cylinder.
- 4—Hinges and mounts.
- 5—Scraper blade push mount connection.
- 6—Cylinder pin mount.
- 7—Piston rod.
- 8—Scraper blade wing segment drive arm.
- 9—Piston rod pin mount.
- 10—Hydraulic hoses (to control lever).
- 13—Cylinder mount bracket.
- 16—Scraper blade top deflector.
- 16'—Scraper blade wing segment top deflector.
- 17—Scraper blade bottom.

17'—Scraper wing blade segment blade bottom.

FIG. 3—Plan View

1—Snow plow scraper blade.
2—Snow plow scraper wing blade segment.
3—Hydraulic cylinder.
4—Hinges and mounts.
5—Scraper blade push connection.
6—Cylinder pin mount.
7—Piston rod.
8—Scraper wing drive arm.
9—Piston rod pin mount.
10—Hydraulic hoses (to control lever).
11—Scraper blade push bars.
12—Push bar connectors to truck/tractor.
13—Cylinder mount bracket.
16—Scraper blade top deflector.
16'—Scraper blade wing segment top deflector.
A—Angle of mount of scraper blade on push bars.

Figure 4:
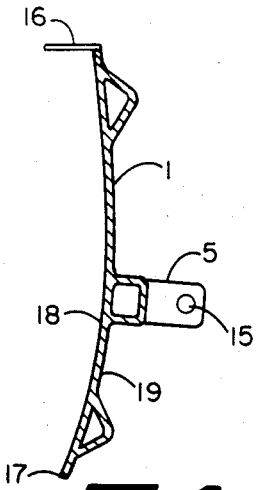

FIG. 4—This is an elevation view of section B—B, of scraper blade 1 where:

1—Snow plow scraper blade.
5—Scraper blade push connection.
16—Scraper blade top deflector.
17—Snow plow scraper blade bottom.
18—Front face of scraper blade.

Figure 5:
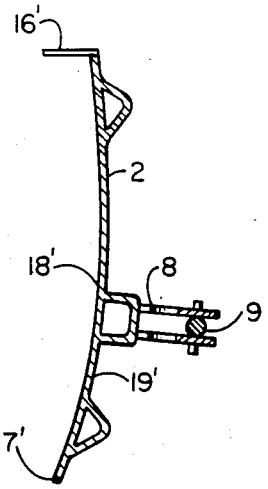

FIG. 5—This is an elevation view of section C—C of snow plow scraper blade segment 2 where:

2—Snow plow scraper wing blade segment.
8—Scraper blade wing segment drive arm.
9—Piston rod pin mount.
16'—Scraper blade wing segment top deflector.
17'—Scraper blade wing segment bottom.
18'—Front face of scraper blade wing segment.

Figure 6:
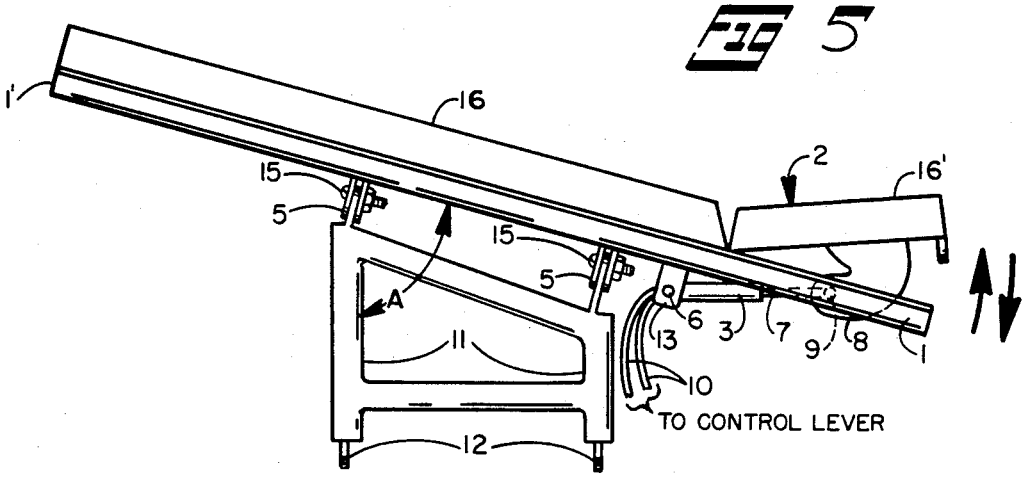

FIG. 6—Plan view—Wing segment mounted on front face of scraper blade:

1—Snow plow scraper blade.
2—Snow plow scraper wing blade segment.
3—Hydraulic cylinder.
5—Scraper blade push connection.
6—Cylinder pin attachment.
7—Piston rod.
8—Scraper wing drive arm.
9—Piston rod pin mount.
10—Hydraulic hoses (to control lever).
11—Scraper blade push bars.
13—Cylinder mount bracket.
16—Scraper blade top deflector.
16'—Scraper blade wing segment top deflector.
A—Angle of mount of scraper blade on push bars.

Figure 7:
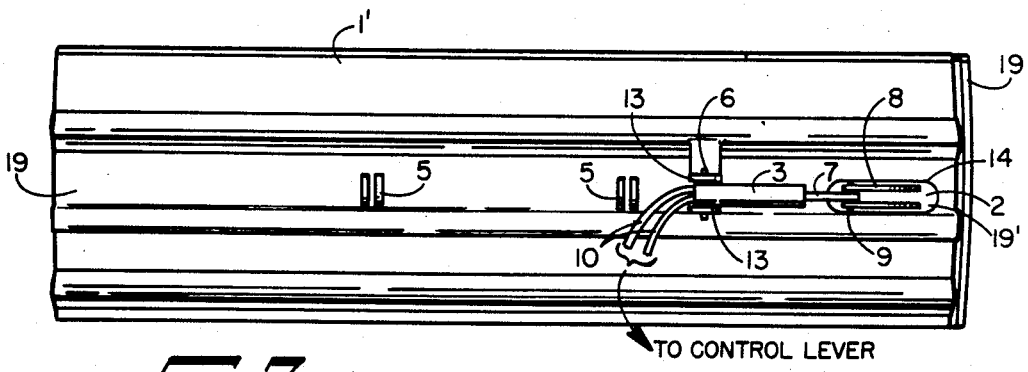

FIG. 7 is a rear elevation view of scraper blade and wing mount, where:

1—Snow plow scraper blade.
2—Snow plow scraper wing blade segment.
3—Hydraulic cylinder.
5—Scraper blade push mount connection.
6—Cylinder pin attachment.
7—Piston rod.
8—Scraper blade wing drive arm.
9—Piston rod pin mount.
10—Hydraulic hoses (to control lever).
13—Cylinder mount bracket.
14—Opening in scraper blade 1 to allow piston actuation of scraper blade wing segment 2.

DETAILED DESCRIPTION

In the following description of this invention, certain terminology will be used for convenience in reference only and will not be limiting. The words "snow plow scraper blade", and as an alternate to this the words "scraper blade" will be used. In addition, the words "snow plow scraper blade wing segment" will be used and as an alternate to the words "scraper blade wing segment".

Other terminology will include the words specifically mentioned above, derivatives thereof, and words of similar import.

This present invention comprises a snow plow scraper blade to be mounted in a conventional manner on the front end of a tractor or truck, and the snow plow scraper blade consisting of two segments. One segment can best be described as the major segment (1) and attached to the trailing edge of this major segment of snow plow scraper blade is a snow plow scraper blade wing segment (2), attached to the major segment (1) by means of hinges (4). A hydraulic piston rod (7) attached to the back (19') of said scraper blade wing segment (2) and hydraulic cylinder (3) attached to the back (19) of the major segment of the snow plow scraper blade (1), actuates piston rod (7) attached to scraper blade wing segment drive arm (8).

The above mentioned hydraulic cylinder (3) can be attached to either the back (19) of the major segment of the snow plow scraper blade (1) or it can be attached to the tractor or truck frame pushing the snow plow.

The utility of this invention is to control the deposition of the snow ridge deposited along the trailing edge of a snow plow scraper blade. This control of the deposition of the snow ridge is attained by actuation of piston rod (7) to force the snow plow scraper wing segment (2) to pivot on the hinges (4) in a forward direction to thus interrupt the snow ridge deposit for example at a driveway.

When the snow plow scraper wing segment (2) is pivoted in a forward position on hinges (4), the "V" angle so formed serves as a trap to hold the snow to thus interrupt the snow ridge deposit.

To further describe the relationship of the snow plow scraper blade assembly, it is to be pointed out that the major segment of the snow plow scraper blade (1), and the snow plow scraper wing segment (2) attached thereto are aligned as a unitary scraper blade. The snow plow scraper wing segment can comprise from about 10% to about 30% of the total length of the scraper blade assembly while the major segment of the scraper blade (1) comprises 70% to 90% of the total length of the scraper blade assembly. The total length of the scraper blade comprises the major segment plus the snow plow scraper wing segment, when aligned as a unitary scraper blade (1 & 2).

There are alternate ways to attach the wing segment to the major segment of the scraper blade.

One of the alternate ways is to mount the snow plow scraper wing segment (2) on the trailing edge of the major segment of the plow scraper blade (1), as shown in FIG. (1) and FIG. (2).

An alternate mounting of the scraper blade wing segment (2) to the major segment of the plow scraper blade (1) such that the trailing edge of the wing segment is aligned with the trailing edge of the major plow segment, as shown in FIG. 6 and FIG. 7, and the hinges (4) are mounted on the face (18) of major segment of the scraper blade, as shown in FIG. 6. The piston rod (3) extends through a slot (14) in major scraper blade (1) and is attached to the scraper blade wing segment drive arm (8).

With the above mounting wherein the trailing edges of each of the said scraper blade wing segment (2) are aligned, conversion of existing snow plows may be readily made to attain the utility of this invention, without extending beyond the trailing edge of the mounted scraper blade.

The snow plow apparatus of this invention is comprised of a snow plow scraper blade (1) and snow plow scraper blade wing segment (2). Hydraulic cylinder (3) mounted on cylinder mount bracket (13) and said mount bracket attached to rear (19) of scraper blade (1). Scraper blade push mount connections (5) are mounted in conventional manner by bolts 15 on the rear of scraper blade (1). Cylinder pin attachment (6) in bracket (13) is mounted on the rear face (19) of scraper blade (1). Hydraulic cylinder (3) is mounted on cylinder pin mount (6) and piston rod (7) of hydraulic cylinder (3) is connected to scraper blade wing segment drive arm (8) by means of piston rod pin mount (9). Hydraulic cylinder (3) is controlled through hoses (10) connected to conventional control valves (not shown).

The snow plow scraper blade apparatus is connected to scraper blade push bars (11) at the rear (19) of scraper blade (1) at scraper blade push connections (5). Push bars (11) are attached to truck or tractor at connectors (12).

The snow plow scraper blade wing segment (2) can be mounted as shown in FIG. (6) on the face (19) of the major snow plow scraper blade (1) such that the trailing edge of said wing segment (2) is at the trailing edge of the major snow plow scraper blade (1), and the hinge mount (4) of the scraper blade wing segment (2) is located on the face (19) of the major snow plow scraper blade (1). The face (19) of scraper blade (1) and face (19') of scraper blade wing segment (2) point in the same direction when scraper blade wing segment (2) is in retracted position, such that the blades (1) and (2) comprise and act as a single scraper blade. On mounting the snow plow scraper blade wing segment as stated above, the scraper blade wing segment drive arm (8) extends from rear (19') of scraper blade wing segment (2) through slot (14) of major snow plow scraper blade (1).

On the top of each scraper blade (1) and (2) is scraper blade top deflector 16 and 16'.

The bottom of major snow plow scraper blade (1) and snow plow scraper blade wing segment (2) are shown as (17) and (17'), respectively.

It is to be pointed out that the prime (') marking on various legend numbers indicates similar components in snow plow scraper blades (1) and (2).

Having described my invention, I claim:

1. Snow plow apparatus wherein the improvement comprises a two component snow plow scraper blade consisting of:

a—a major segment of snow plow scraper blade
b—a snow plow scraper wing segment attached to said major segment of scraper blade
c—and wherein trailing edge of said snow plow scraper wing segment aligns with trailing edge of said major segment of snow plow scraper blade
d—and leading edge of said snow plow scraper wing segment is attached by hinge mounts to said major segment of snow plow scraper blade
e—to allow forward and return pivot action of said scraper wing segment trailing edge
f—hydraulic piston rod extending through slot of said major segment of snow plow scraper blade and
g—said hydraulic piston rod attached to scraper wing drive arm
h—said scraper wing drive arm attached to back of said scraper wing blade segment
i—and means to actuate said hydraulic piston rod
j—to move said scraper wing blade segment in a forward and return direction.

2. Snow plow appartus of claim 1 wherein the improvement comprises a major segment of snow plow scraper blade and a snow plow scraper wing segment hingedly attached to said major segment of snow plow scraper blade, and wherein said scraper wing segment extends to from 10% to 30% of the length of said major segment of snow plow scraper blade.

3. Snow plow apparatus wherein the improvement comprises a two component snow plow scraper blade consisting of:

a—a major segment of snow plow scraper blade
b—a snow plow scraper wing segment attached to said major segment of scraper blade
c—hinge mounts connecting said scraper wing blade segment to said major segment of scraper blade, and
d—trailing edge of said wing segment is aligned with the trailing edge of said major segment, and
e—leading edge of said wing blade segment is hingedly joined to the face of said major segment of scraper blade, and
f—a slot is provided in said major segment of scraper blade for piston rod actuation of scraper wing drive arm
g—hydraulic piston rod attached to scraper wing drive arm
h—said scraper wing drive arm attached to back of said scraper wing blade segment
i—and means to actuate said hydraulic piston rod
j—to move said scraper wing blade segment in a forward and return direction.

* * * * *